US006419119B1

(12) United States Patent
Tam

(10) Patent No.: US 6,419,119 B1
(45) Date of Patent: Jul. 16, 2002

(54) EFFICIENT PASTE DISPENSER

(76) Inventor: Isaac Y. Tam, 470 Americano Way, Fairfield, CA (US) 94533

( * ) Notice: Subject to any disclaimer, the term of this patent is extended or adjusted under 35 U.S.C. 154(b) by 0 days.

(21) Appl. No.: 09/842,994

(22) Filed: Apr. 27, 2001

(51) Int. Cl.[7] ..... B65D 35/00
(52) U.S. Cl. ..... 222/107; 222/92
(58) Field of Search ..... 222/107, 92

(56) References Cited

U.S. PATENT DOCUMENTS 1,266,413 A * 5/1918 Crump ..... 222/107
1,844,215 A * 2/1932 Edwards ..... 222/105
2,400,716 A * 5/1946 Sattler ..... 222/107
3,648,895 A * 3/1972 Strazdins ..... 138/119
4,579,254 A * 4/1986 Puskarcik ..... 222/103
4,657,159 A * 4/1987 Grant ..... 222/107
5,600,933 A * 2/1997 Wiles et al. ..... 222/107
5,647,511 A * 7/1997 Bond ..... 222/105

* cited by examiner

*Primary Examiner*—Lesley D. Morris
*Assistant Examiner*—Stephanie Willatt

(57) ABSTRACT

A collapsible tube paste dispenser is disclosed, wherein the dispenser has a head portion that consists of two concave symmetrical parts. One of the symmetrical parts is a concave collapsible part, the other is a concave rigid end plate. Apart from conventional paste dispensers, the outlet structure is mounted laterally instead of mounted axially on the end plate, to accommodate a broad and smooth end plate, for easy and smooth operation. When the tube is emptied, the concave collapsible part will collapse and fit perfectly into the broad and smooth concave rigid end plate, resulting in an effortlessly total evacuation of the content of the tube.

4 Claims, 2 Drawing Sheets

EFFICIENT PASTE DISPENSER

BACKGROUND

1. Field of the Invention

This invention is related to my earlier application with an application number of Ser. No. 09/360/835, entitled "Efficient Paste Dispenser", abandoned due to a lack of detailed specifications which, with its novel features could have distinguished itself from prior art. The invention deals with a collapsible tube paste dispenser for dispensing paste materials such as toothpaste, medicinal creams and ointments.

2. Prior Art

Heretofore, it is not easy to squeeze out the last bit of paste from a conventional collapsible tube dispenser. The tube will collapse into irregular shapes with pockets of paste inside that even people with strong fingers will find difficult to tackle. There are a few attempts in the past to solve this problem, exemplified by Stazdins' "Collapsible Tube Containers", with U.S. Pat. No. 3,648,895, wherein the tube wall is comprised of even number of longitudinal plates connected by thin areas that form hinge lines in between these longitudinal plates. When pressed onto each other, these plates are supposed to aid the evacuation of the paste. The outlet is disposed along the longitudinal axis of the tube. In the shoulder area near the connection between the outlet and the tube, one side of the tube is thinner than the other side, so that the thinner side will collapse onto the thicker side of the tube, supposedly leaving no wrinkles. Stazdins does not teach how the thin part would collapse onto the thick part in the shoulder area where the tube gradually narrows down to meet the axially mounted cylindrical outlet. According to the two-dimensional drawings provided, Stazdins implies that the thick part will remain flat so that the thin part can be pressed onto it easily. There is no where in the drawings that suggests a concave plate where the thin part can collapse into. In reality, in a three-dimensional situation, the shoulder area near the connection to the axially mounted outlet, is likely to be forced into forming a deep and narrow depression where the thin part is impossible to collapse into. This problem can not be avoided as long as the outlet is axially mounted. Furthermore, the segmented tube wall with thick areas hinged together by thin hinge lines will do very little in helping the total. evacuation of the contents. But the cost of making such will be greatly increased. Conventional tube walls with uniform thickness and flexibility will be just as effective.

Other attempts to solve the problem such as Chen's "Self-closing Liquid Dispensing Package" with U.S. Pat. No. 5,529,224 and O'Conner's "Disposable Shaker Packet" with U.S. Pat. No. 2,956,710 are for holding and dispensing very small quantities of contents. They do not, and neither do they need to have an end plate to support a rigid outlet structure, as does the current invention. They are not symmetrical in a manner so that one side will collapse and fit perfectly into the other side, so that the contents can be completely evacuated. There will be inevitably pockets, creases, and wrinkles formed in between the two sides.

OBJECTS OF THE INVENTION

It is an object of this invention to provide a collapsible tube paste dispenser that can easily and smoothly empty all its contents.

SUMMARY OF THE INVENTION

This is a collapsible tube dispenser for paste. It can totally-and smoothly evacuate its contents by collapsing one part of the tube into another part of the tube and the two parts will fit perfectly together without pockets, creases, and wrinkles, because the two parts are symmetrical. There is a broad, smooth, concave, rigid end plate mounted at one end of the tube and laterally on one side of the longitudinal axis of the tube. An outlet structure is not mounted axially along the longitudinal axis of the tube, as that in a conventional paste dispenser, but mounted laterally on one side of the longitudinal axis, on the laterally mounted end plate. When the collapsible and symmetrical counter part of the end plate collapses into the end plate, the two parts will fit perfectly and smoothly, forcing out the last bit of paste through the laterally mounted outlet.

DETAILED DESCRIPTION OF THE INVENTION

Figure 1:
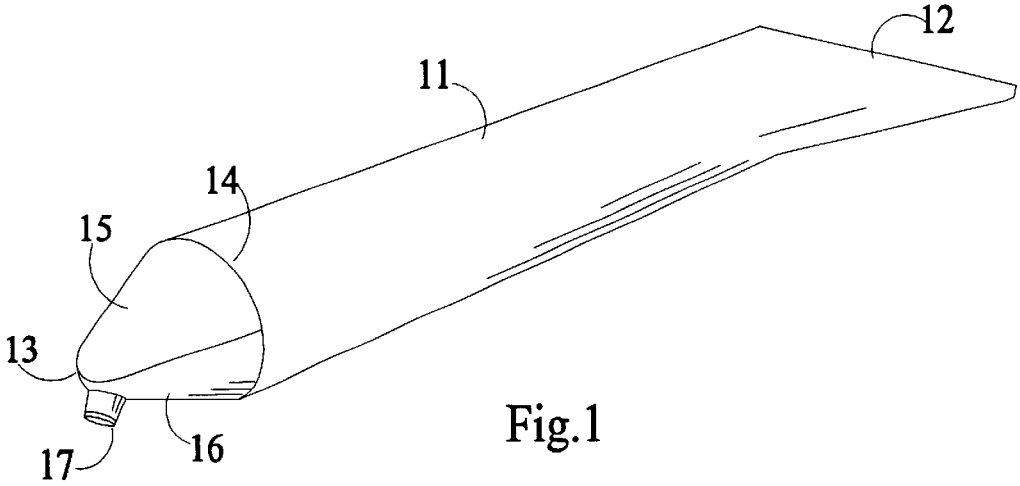
FIG. 1 is a perspective view of an embodiment of the invention showing the shape of the dispenser when it is fully filled.
Figure 2:
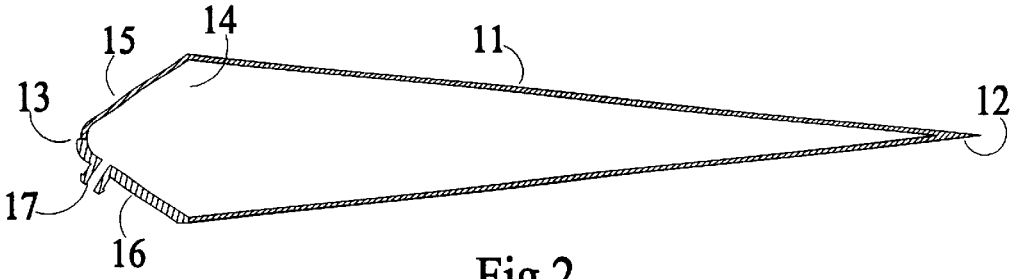
FIG. 2 is a longitudinal section of the embodiment in FIG. 1, showing the shape of the dispenser when it is fully filled.
Figure 3:
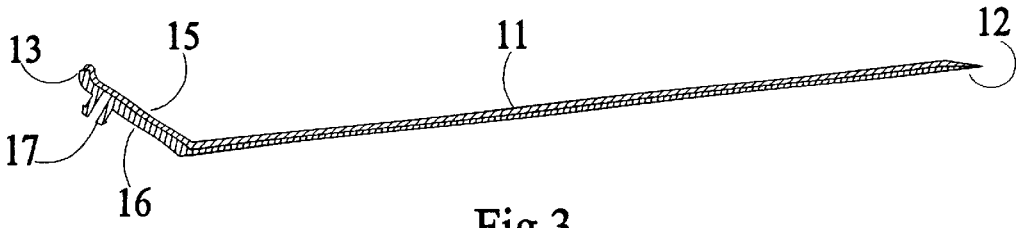
FIG. 3 is a longitudinal section of the embodiment in FIG. 1, showing the shape of the dispenser when it is totally empty.

FIG. 1, FIG. 2, and FIG. 3 show a first preferred embodiment of the invention, wherein FIG. 1 is a perspective view of the embodiment, showing the shape of the dispenser when it is fully filled, FIG. 2 is a longitudinal section of the embodiment shown in FIG. 1, showing the shape of the dispenser when it is fully filled, FIG. 3 is a longitudinal section of the embodiment shown in FIG. 1, showing the shape of the dispenser when it is totally empty.

In FIG. 1, FIG. 2, and FIG. 3, 11 is the main tube portion of the dispenser, made of collapsible sheet material with uniform thickness and flexibility; 12 is the sealed tail portion of the dispenser; 13, 14, 15, 16, and 17 together form the head portion of the dispenser; 13 is. the close end of the head portion; 14 is the open end of the head portion; 15 is the collapsible part of the head portion, which is the continuation of main tube portion 11; 16 is the end plate of the head portion, made of rigid material, having a concave shape and a smooth and broad inner surface, end plate 16 is laterally disposed on one side of the longitudinal axis (not shown) of the tube; 17 is a laterally mounted side-firing outlet mounted on end plate 16 of the head portion, for letting out of paste. Since side-firing outlet 17 is mounted laterally instead of axially, end plate 16 can be made broad and smooth, and collapsible part 15 can fit in it easily.

The head portion of the dispenser has a diameter decreasing gradually from open end 14 toward close end 13, to a complete closure at close end 13, assuming a broadly blunt shape. This obtuseness of the head portion is to accommodate a broad and smooth end plate 16 for easy and smooth operation. Open end 14 of the head portion connects to main tube portion 11.

Collapsible part 15 of the head portion is laterally disposed on one side of the longitudinal axis (not shown) of the tube, and is symmetrical to end plate 16 of the head portion. When the dispenser is squeezed to be emptied, collapsible part 15 will collapse into end plate 16, and fits perfectly in it, because the two parts are symmetrical, leaving no wrinkles, creases, or pockets of paste, as illustrated in FIG. 3.

Figure 4:
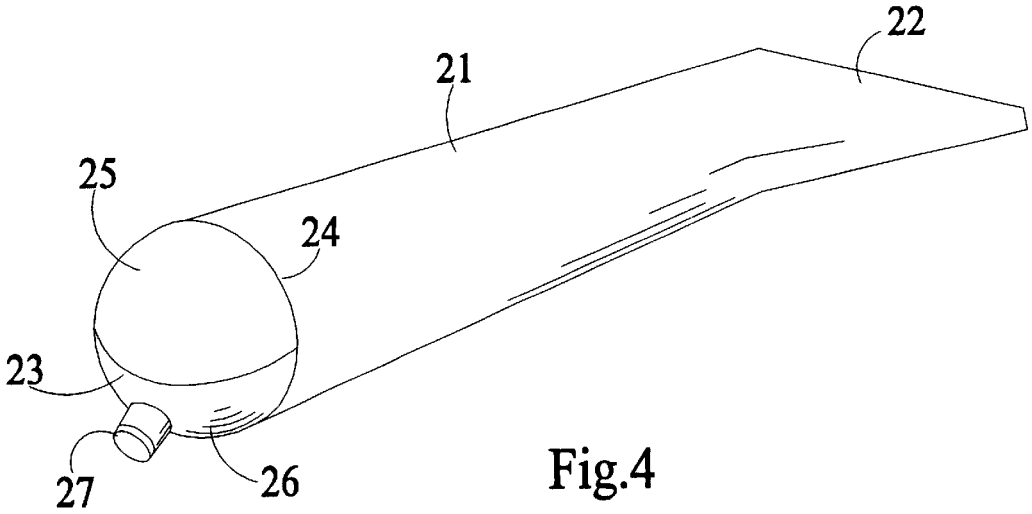
FIG. 4 is a perspective view of another embodiment of the invention, wherein the shape of the head portion of the dispenser is hemispheric.

FIG. 4 shows a second preferred embodiment of the invention having a hemispheric head portion, wherein 21 is the main tube portion of the dispenser, made of collapsible sheet material with substantially uniform thickness and flexibility; 22 is the sealed tail portion of the dispenser; 23, 24, 25, 26, and 27 together form the head portion of the dispenser; 23 is the close end of the head portion, which is broadly blunt as clearly shown in FIG. 4; 24 is the open end of the head portion connected to main tube portion 21; 25 is the collapsible part of the head portion, which is the continuation of main tube portion 21; 26 is the end plate of the head portion made of rigid material, having a concave shape and a smooth and broad inner surface; 27 is the laterally disposed side-firing outlet mounted on end plate 26, for letting out of paste.

This second preferred embodiment shown in FIG. 4 works the same way as the first preferred embodiment illustrated in FIG. 1, FIG. 2, and FIG. 3. The hemispheric head portion of the second preferred embodiment provides very smooth engagement between collapsible part 25 and end plate 26 when the dispenser is collapsed.

While my above description contains many specificities, these should not be construed as limitations on the scope of the invention, but rather as an exemplification of a few preferred embodiments thereof. Many other variations are possible. Accordingly, the scope of the invention should be determined not by the embodiments illustrated, but by the appended claims and their legal equivalents.

What is claimed is:

1. An efficient paste dispenser comprising:

a) a collapsible tube having a sealed tail portion, and a head portion, for holding and dispensing a paste;

b) said head portion having a gradually decreasing diameter to a closure toward one end thereof, said head portion comprising two symmetrical parts, one of said symmetrical parts being a rigid concave end plate having a broad and smooth inner surface, disposed laterally on one side of the longitudinal axis of said collapsible tube, the other of said symmetrical parts being a collapsible counter part of said concave end plate, disposed laterally on the other side of said longitudinal axis, in opposition to said concave end plate;

c) a laterally disposed side-firing outlet for letting out said paste from the inside of said collapsible tube, said side-firing outlet fixedly mounted on said concave end plate of said head portion.

2. An efficient paste dispenser as defined in claim 1, wherein the shape of said head portion is hemispheric.

3. An efficient paste dispenser comprising:

a) a collapsible tube having a sealed tail portion and a broadly blunt head portion, for holding and dispensing a paste;

b) said broadly blunt head portion comprising a rigid concave end plate, and a collapsible symmetrical counter part of said concave end plate;

c) said concave end plate having a broad and smooth inner surface, disposed laterally on one side of the longitudinal axis of said collapsible tube;

d) said collapsible symmetrical counter part disposed laterally and symmetrically on the other side of said longitudinal axis, in opposition to said concave end plate;

e) a laterally disposed side-firing outlet fixedly mounted on said concave end plate.

4. An efficient paste dispenser as defined in claim 3, wherein said broadly blunt head portion is hemispheric.

* * * * *